US011408140B2

(12) United States Patent
Groombridge

(10) Patent No.: US 11,408,140 B2
(45) Date of Patent: Aug. 9, 2022

(54) PILE CROPPERS AND METHODS FOR CUTTING PILES

(71) Applicant: CREATIVE CRUSHERS LTD, Atherstone (GB)

(72) Inventor: Warren Groombridge, Atherstone (GB)

(73) Assignee: CREATIVE CRUSHERS LTD, Atherstone (GB)

( * ) Notice: Subject to any disclaimer, the term of this patent is extended or adjusted under 35 U.S.C. 154(b) by 997 days.

(21) Appl. No.: 16/085,835

(22) PCT Filed: Mar. 17, 2017

(86) PCT No.: PCT/GB2017/050744
§ 371 (c)(1),
(2) Date: Sep. 17, 2018

(87) PCT Pub. No.: WO2017/158372
PCT Pub. Date: Sep. 21, 2017

(65) Prior Publication Data

US 2019/0112776 A1 Apr. 18, 2019

(30) Foreign Application Priority Data

Mar. 18, 2016 (GB) ..... 1604625
May 13, 2016 (GB) ..... 1608442

(51) Int. Cl.
*E02D 9/00* (2006.01)

(52) U.S. Cl.
CPC ..... *E02D 9/00* (2013.01); *E02D 9/005* (2013.01)

(58) Field of Classification Search
CPC combination set(s) only.
See application file for complete search history.

(56) References Cited

U.S. PATENT DOCUMENTS 4,934,616 A 6/1990 Zepf
5,007,593 A * 4/1991 Berczes ..... B28D 1/222 125/23.01
5,772,363 A 6/1998 Larson

FOREIGN PATENT DOCUMENTS

CN 201400892 Y 2/2010
GB 2519380 A 4/2015
WO WO-2010133862 A2 * 11/2010 ..... E02D 9/005

OTHER PUBLICATIONS

International Search Report and Written Opinion for corresponding PCT application No. PCT/GB2017/050744, dated Jul. 7, 2017.

* cited by examiner

*Primary Examiner* — Kyle Armstrong
(74) *Attorney, Agent, or Firm* — Notaro, Michalos & Zaccaria P.C.

(57) ABSTRACT

An apparatus for cutting a pile having a pair of cutting members having a first cutting member having a first cutting edge and a second cutting member having a second cutting edge. The first and second cutting members are pivotally mounted at separate primary pivot axes and are moveable about the primary pivot axes in order to move the first and second cutting edges with respect to each other between rest and cutting positions. The first and second cutting edges are parallel with respect to each other when in their respective cutting positions.

18 Claims, 3 Drawing Sheets

PILE CROPPERS AND METHODS FOR CUTTING PILES

TECHNICAL FIELD OF THE INVENTION

The present invention relates to improvements in or relating to pile croppers and methods of cutting concrete piles.

BACKGROUND TO THE INVENTION

It is common to provide piles in the construction of buildings and other structures. Piles are typically in the form of concrete columns, and often include steel rebars therethrough for support. Concrete piles are commonly used for foundation work for buildings or other structures. When used for this purpose, the piles are driven into the ground and in doing so often results in upper portion of the column protruding above ground level which must then be removed.

Prior art pile croppers typically include one or more cutting jaws moveable under the operation of an operating ram, which is commonly a pneumatic or hydraulic ram. The cutting jaws contact a surface or surfaces of the concrete pile and the force applied by the operating ram is sufficient to cut the concrete. However, these prior art pile croppers suffer a number of drawbacks.

Known solutions include providing an apparatus which includes one or more cutting jaws which may be moved against the pile in order to cut the protruding portion. The force required to cut the pile is very large and therefore requires the provision of an operating ram which may operate at large working pressures. This results in an apparatus which is large and is high in cost.

It would therefore be advantageous to provide a pile cropper which is significantly smaller than known devices. It would also be advantageous to provide a pile cropper which may be manufactured and operated at a lower cost than prior art croppers.

In some known pile croppers there are two jaws which rotate about a single pivot and which are operated simultaneously to cut piles. Rotation of two jaws about a single pivot results in reduced control of the jaws, and this type of pile cropper tends to result in complete cutting of both the concrete column and the steel rebars within the concrete column, irrespective of the degree of cutting required. It is also not possible to adjust the pressure exerted by individual jaws using a single pivot system.

In other known pile croppers, the cropper includes three or more jaws arranged radially around a central aperture, through which a pile may extend as the cropper is lowered onto it. The radial jaws may be rotated about a single pivot or each jaw may have its own pivot. These croppers are generally large in size and can suffer through non-parallel alignments of their cutting jaws, and for an inability for all the jaws to completely meet when cutting through piles. The non-parallel alignment of the cutting jaws may also result in an unsatisfactory finish on the uncut pile. As a result, the uncut pile must be saw cut at the required finish level. This extra step increases costs, complexity and is potentially hazardous.

Furthermore, known pile croppers are commonly suited to a single form of pile and generally comprise cutting jaws arranged radially about a central aperture, wherein the central aperture defines the shape and size of pile which may be cut using the cropper. For example, a cropper may have a circular or square central aperture and the respective croppers may be suited to only cut piles having a corresponding cross-section, i.e. square piles or circular piles. However, it would be advantageous to provide a cropper which may be used to cut piles having any shaped cross-section.

In addition, known pile croppers generally allow cut sections of piles to disintegrate or fall in situ after cutting. This is hazardous as it generally involves falling concrete debris which could fall on an operative. It is also possible for the falling/disintegrating cut section of the pile to damage the integrity of the uncut section of the pile. It would therefore be advantageous to provide a pile cropper capable of moving the cut section of the pile away from the uncut pile after cutting in order to move the cut section of the pile to a separate location for disposal thereof.

It is therefore an aim of an embodiment or embodiments of the present invention to overcome or at least partially mitigate the problems associated with the prior art.

SUMMARY OF THE INVENTION

According to a first aspect of the present invention there is provided an apparatus for cutting a pile comprising a pair of cutting members comprising a first cutting member having a first cutting edge and a second cutting member having a second cutting edge; wherein the first and second cutting members are pivotally mounted at separate primary pivot axes and are moveable about said primary pivot axes in order to move the first and second cutting edges with respect to each other between rest and cutting positions, and wherein the first and second cutting edges are substantially parallel with respect to each other when in their respective cutting positions.

Providing an apparatus wherein the cutting edges are substantially parallel with respect to each other in their cutting positions provides a better, clean cut of a pile. The clean cut provided by the apparatus of the invention removes or reduces the need for a pile to be subsequently cut using a saw to level off the uncut pile. Furthermore, providing a clean cut of the pile prevents or at least reduces the possibility of pile fracturing during the cutting process.

In some embodiments the cutting edges may be moveable to a position wherein they are substantially parallel to one another when moving from their respective rest positions to their cutting positions. However, in presently preferred embodiments the apparatus is configured such that the cutting edges are positioned substantially parallel to one another in both their rest position and their cutting positions and remain parallel when moving between these positions, in use.

In some embodiments the first and second cutting edges may be in their respective rest positions when they are separated by a given distance and may be moveable to their respective cutting positions by moving the cutting edges closer together. In their respective rest positions the first and second cutting edges may be separated by up to 0.1 m, or at least 0.1 m, 0.15 m, 0.2 m, 0.25 m, 0.3 m, 0.35 m, 0.4 m or 0.5 m, for example. In some embodiments the first and second cutting edges may be separated by between 0.2 m and 0.4 m, by between 0.25 m and 0.35 m or by approximately 0.325 m in their respective rest positions. In their respective cutting positions the first and second cutting edges may be brought into contact, or may be separated by up to 0.01 m, or at least 0.01 m, 0.025 m, 0.05 m, 0.075 m, 0.1 m, 0.15 m, 0.2 m, 0.25 m or 0.3 m, for example. In some embodiments the first and second cutting edges may be separated by between 0.05 m and 0.15 m, by between 0.075 m and 0.125 m or by approximately 0.11 m in their respective cutting positions. The distance between the cutting edges in their rest and cutting positions is dependent on the shape and dimensions of the pile to be cut, and may be adjustable in order to enable the apparatus of the invention to be used to cut piles of varying shapes and dimensions, in use.

The cutting edges may comprise a substantially linear edge configuration. Alternatively, the profile of the cutting edges may be variable and may include one or more protrusions and/or recesses. The protrusions or recesses within the cutting edges may be provided to vary the force profile across a pile, in use, in order to improve the cutting ability of the apparatus. The cutting edges may comprise teeth or indents.

In some embodiments the cutting members may comprise a cutting surface. In such embodiments, the cutting edges of the cutting members may at least partially define the cutting surface of the corresponding cutting member. In some embodiments the cutting surfaces may comprise one or more grooves therein. The groove/s may comprise an indented portion of the cutting surface. The groove/s may extend to an edge of the cutting surface which may in some embodiments comprise the cutting edge of the corresponding cutting member. In such embodiments, the groove/s may form corresponding teeth or indents in the cutting edges. By providing teeth or indents in the cutting edges of the cutting members, the cutting edges may be prevented from coming into contact with steel reinforcement rebars within a pile to be cut, in use. In this way, the pile may be cut without cutting the steel rebar.

In some embodiments the cutting member may comprise a body portion. The body portion preferably comprises a solid block of material. The cutting edge of the cutting member may form an edge of the body portion. In some embodiments the cutting surface of the cutting member may form a surface of the body portion of the member.

In some embodiments the primary pivot axes may be provided through the body portion of the corresponding cutting member. The primary pivot axes may be provided substantially centrally through the respective body portion of the cutting member. In this way, the cutting members may be rotatable about their respective primary pivot axes through rotation of the body portion about said axes. In some embodiments the primary pivot axes may be provided proximal to the cutting edges of the respective cutting members. Providing a pivot axes centrally or proximal to the cutting edges through a body portion of the cutting members provides greater control over the extent to which the cutting edges may be moved, in use, when compared with pivotally mounting the cutting member at a distal end or periphery thereof. The primary pivot axes may be positioned no more than 5 cm or at least 5 cm, 10 cm, 15 cm, 20 cm, 25 cm, 30 cm, 40 cm, 50 cm, 75 cm, 1 m or 1.5 m from the cutting edges, for example. The cutting members may be rotatable about their respective primary pivot axis through an angle of no more than 2°, or through an angle of at least 2°, 4°, 6°, 8°, 10°, 15°, 20° or 30°, for example.

The cutting members may be formed from any rigid material capable of cutting through concrete or other pile material. Preferably, the cutting members are formed from a metallic material. In some embodiments the cutting members are at least partly formed from steel.

In use, the apparatus may be located on or about a pile by positioning a pile to be cut between the cutting edges of the first and second cutting members such that upon movement of the cutting edges from their respective rest positions towards their respective cutting positions, the cutting edges are configured to act upon opposing surfaces of the positioned pile and apply a force thereto. The apparatus may be configured such that the cutting edges, upon movement from their respective rest positions towards their cutting positions, are capable of applying a force to a pile of up to 50 kN, or at least 50 kN, 100 kN, 150 kN, 200 kN, 250 kN, 300 kN, 350 kN, 400 kN, 450 kN, 500 kN, 550 kN or 600 kN, for example.

In some embodiments the apparatus may comprises a supporting frame to which one or more components of the apparatus may be mounted. For example, in some embodiments the first and second cutting members may be directly mounted to the supporting frame. In such embodiments, the respective primary pivot axes of the cutting members may form a portion of the supporting frame. In some embodiments the first and second cutting members may be mounted to the supporting frame via an intermediate member. In such embodiments, the respective primary pivot axes of the cutting members may comprise a separate component of the apparatus to the supporting frame.

The supporting frame may enclose at least part of one or more moving components of the apparatus. For example, in some embodiments the supporting frame may enclose at least part of the first and/or second cutting members. In some embodiments the supporting frame may comprise one or more actuator guards which may at least partially enclose an actuator. Providing an apparatus wherein the moving parts are at least partially enclosed increases the operational safety of the device.

In some embodiments the supporting frame may comprise an opening into which a portion of a pile may be located, in use, for cutting. Preferably, the opening may be positioned between the cutting edges of the first and second cutting members when said edges are in a rest position. In this way, the pile may be located within the opening with the cutting edges in their rest position, which may subsequently be moved under the operation of the apparatus to their respective cutting positions in order to cut the pile. The opening may comprise a bore (or tunnel) through the supporting frame.

In some embodiments, the apparatus comprises a supporting frame having a bore therethrough for locating at least a portion of a pile to be cut, in use, wherein the bore and optionally the supporting frame comprises an octagonal cross section.

Providing a bore through the supporting frame of the apparatus which is octagonal in shape allows for the pile cutting apparatus of the invention to be used to cut piles having various cross-sectional profiles whilst minimising the size of the apparatus as a whole. For example, whilst a circular bore is operable to receive a square pile, providing an octagonal bore allows for square piles of greater dimensions to be cut using the apparatus without needing to increase the size of the supporting frame as a whole. An octagonal bore is particularly suited to receiving portions of piles which have a circular or square cross-section, but it operable to receive portions of piles having different cross-sectional profiles such as triangular, pentagonal, hexagonal or octagonal piles, for example.

In some embodiments, the supporting frame may comprise one or more handles. The one or more handles may be operable in use to be gripped by a user in order to move the apparatus. In some embodiments the supporting frame may additionally comprise one or more connection points for connecting a lifting mechanism thereto. The one or more connection points may comprise one or more apertures through the supporting frame.

The first and second cutting members may be additionally mounted at respective secondary pivot axes. In such embodiments, the first and second cutting members may be directly mounted onto a supporting frame at the respective secondary pivot axes. In such embodiments, the first and second secondary pivot axes may form part of the supporting frame such that the first and second cutting members are fixedly mounted at respective secondary pivot axes. In alternative embodiments, the respective secondary pivot axes may not form part of the supporting frame, but may be separate components which are moveable with respect to the supporting frame, in use.

The first and second cutting members may be rotatable with respect to respective secondary pivot axes. The cutting members may be rotatable about their respective secondary pivot axis through an angle of no more than 2°, or through an angle of at least 2°, 4°, 6°, 8°, 10°, 15°, 20° or 30°, for example.

In some embodiments, all of the primary pivot axes and secondary pivot axes may be aligned in the same plane in the rest position, and may be aligned linearly. Thus, in such embodiments all of the primary and secondary pivot axes of the first and second cutting members are parallel in the same plane, or in a line. This enables the apparatus to be manufactured in a compact format, and minimises the movement of the cutting members required to cut a pile within the apparatus, therefore saving energy and reducing the amount of wear and tear on any actuator or ram used to move the cutting members. In addition, the alignment of all primary and secondary pivot axes in the same plane in the rest position ensures that less force is required to move the cutting members to the cutting position, in use. The secondary pivot axes may be located on an opposite side of the cutting members to the cutting edges. Thus in preferred embodiments the cutting members comprise a cutting edge located on one side, and a secondary pivot axis on the other side, of a primary pivot axis. The orientation of the plane or line defining the planar or linear alignment of the primary and secondary pivot axes may be moveable, in use, as the primary and/or secondary pivot axes are moved. The secondary pivot axes may be separated from respective primary pivot axes by a distance of no more than 5 cm, or at least 5 cm, 10 cm, 15 cm, 20 cm, 25 cm, 30 cm, 40 cm, 50 cm, 75 cm, 1 m or 1.5 m, for example.

The apparatus may comprise one or more actuators. In such embodiments, the cutting members may be moveable about their respective primary pivot axes under the operation of said one or more actuators. In some embodiments the apparatus may comprise two actuators. In such embodiments, the cutting members may be moveable about their respective primary pivot axes under the operation of respective actuators, the respective actuators comprising a first actuator operable to control the movement of the first cutting member and a second actuator operable to control the movement of the second cutting member.

In some embodiments the or each actuator may comprise an operating ram. The operating ram may be a hydraulic or pneumatic operating ram, for example. In such embodiments, the apparatus may additionally comprise one or more supply lines to the or each operating ram to supply a fluid thereto, and/or one or more waste lines for removing a fluid from the or each operating ram. In some embodiments the or each operating ram may comprise a main body portion which is coaxial with and surrounds an inner extending arm. The extending arm may be operable in use to be projected from within the body portion to extend therefrom.

In embodiments wherein the one or more actuators comprise a hydraulic or pneumatic operating ram, the or each operating ram may be configured to have a working pressure of up to 5 MPa, or at least 5 Mpa, 10 Mpa, 15 Mpa, 20 Mpa, 25 Mpa, 30 Mpa, 40 Mpa or 50 Mpa, for example. In some embodiments the or each operating ram is configured to have a working pressure of approximately 21 Mpa. In some embodiments the or each operating ram is configured to have a working pressure of approximately 24 Mpa.

In some embodiments the one or more actuators may comprise a moveable portion which may act directly on one or both of the cutting members, or a surface thereof, in order to effect movement of the cutting members about their respective primary pivot axes. In embodiments wherein the cutting members are additionally mounted at respective secondary pivot axes, the one or more actuators may comprise a moveable portion which is operable in use to move the secondary pivot axes of the cutting members in order to effect movement of the cutting members about the primary pivot axes. For example, the moveable portion of the or each actuator may be operable to cause the secondary pivot axes of the cutting members to move laterally or rotationally. In such embodiments, the cutting members may then be rotatable about said secondary pivot axes upon lateral or rotational movement of the respective secondary axes, said rotation about the secondary pivot axes urging the cutting members to move about their respective primary pivot axes in a desired direction.

The or each actuator may comprise an elongate member having opposing ends. In such embodiments, the or each actuator may be operably connected at a first end to one of the first or second cutting members, or in some embodiments to the secondary pivot axis of one of the first or second cutting members, and may be operably connected at an opposing second end to a further component of the apparatus. The further component of the apparatus may preferably be a supporting frame. In embodiments comprising two actuators operable to effect movement of one of the cutting members, each actuator may be connected at a first end to one of the first or second cutting members, or to the corresponding secondary pivot axis of the relevant cutting member, and at a second end to a supporting frame.

The connection of the or each actuator to a supporting frame may comprise a fixed connection. In other embodiments the or each actuator may be moveably connected to a supporting frame. For example, the or each actuator may be rotatably connected to a supporting frame at an actuator pivot axis and may be moveable with respect thereto, in use. The apparatus may be configured such that the movement of the or each actuator with respect to a supporting frame may effect a corresponding movement of a connected cutting member. In this way, both the movement of the cutting members about their respective primary pivot axes, and in some embodiments about their secondary pivot axes, along with the movement of a connected actuator with respect to a supporting frame may effect movement of the cutting edges with respect to each other between respective rest and cutting positions, in use.

The or each actuator may be rotatably connected at a corresponding actuator pivot axis, and the or each actuator pivot axis may be aligned in the same plane as a primary and/or secondary pivot axis. In some embodiments the or each actuator pivot axis may be aligned linearly with a primary and/or secondary pivot axis. In presently preferred embodiments, wherein the apparatus comprises separate actuators for each of the first and second cutting members, each actuator may be connected to a supporting frame at an actuator pivot axis which is aligned in the same plane as the primary pivot axis of the corresponding cutting member. The alignment of the actuator pivot axes and primary pivot axes may be linear. In preferred embodiments, the actuator pivot axes may be located substantially vertically above the corresponding primary pivot axis, in use. In embodiments wherein the or each actuator comprises an operating ram, the or each ram may be operably connected to one of the first or second cutting members, or in some embodiments to the secondary pivot axis of one of the first or second cutting members, at a first end which may comprise a portion of an extending arm of the operating ram. In such embodiments, the or each operating ram may be operably connected to a further component of the apparatus at a second end, wherein the second end of the operating ram may comprise a portion of a main body portion of the operating ram.

The apparatus may comprise a supporting frame having an bore therethrough for locating at least a portion of a pile to be cut, in use; and a plurality of cutting members arranged about and rotatably mounted to the supporting frame, each cutting member comprising a cutting edge moveable between a rest position and a cutting position for cutting a pile at least partly located within the bore of the supporting frame; wherein the cutting members are arranged to form a base formed from at least part of each cutting member which is operable in use to retain a cut section of a pile within the bore when the corresponding cutting edges are in their respective cutting positions.

In such embodiments, the apparatus allows for a pile to be cut, and for the cut section to be subsequently removed from the uncut section of the pile and disposed of, preferably in a designated area away from the cut pile, without the need for any additional equipment. This also improves the operational safety of the device when compared with other known apparatus which may allow for at least part of the cut section of the pile to disintegrate or fall on or about the uncut section of the pile which may be hazardous for operatives but also could damage the integrity of the uncut section of the pile.

The cutting members are arranged to form a base formed from at least part of each cutting member. In some embodiments the part of each cutting member forming the base may comprise at least portion of a cutting surface of the cutting members. The cutting surface may be a substantially planar surface. Alternatively, the cutting surface of each cutting member may be curved. In some embodiments the cutting surface of each cutting member may be at least partially defined by the cutting edge of the corresponding cutting member.

In some embodiments the apparatus comprises a first pair of cutting members comprising a first cutting member having a first cutting edge and a second cutting member having a second cutting edge. In such embodiments, in their respective cutting positions, the first and second cutting edges may be brought into contact with one another to form the base.

In further embodiments the apparatus may comprise a second pair of cutting members comprising a third cutting member having a third cutting edge and a fourth cutting member having a fourth cutting edge. In such embodiments, in their respective cutting positions, the third and fourth cutting edges may be brought into contact with one another to form the base. Alternatively, the third and/or fourth cutting edges may be brought into contact with the first and/or second cutting edges to form the base.

In embodiments comprising first and second pairs of cutting members, the first pair of cutting members may have primary and secondary pivot axes which are all in the same plane and which may align linearly in the rest position (as described hereinabove), and the second pair of cutting members may have primary and secondary pivot axes which are all in the same plane and which may be aligned linearly in the rest position. The primary and secondary pivot axes of all of the cutting members of both the first and second pairs of cutting members may be aligned in the same plane, in the rest position. The first pair of cutting members and the second pair of cutting members may be aligned substantially orthogonally to one another, and thus may, for example be located in a ring, with each cutting member aligned at 90° with respect to adjacent cutting members. In this way the first pair of cutting members may have primary and secondary pivot axes aligned in the same plane and linearly, while the second pair of cutting members may have primary and secondary pivot axes aligned in the same plane as the primary and secondary pivot axes of the first pair, but which may be aligned linearly but orthogonally to the linear direction of the primary and secondary pivot axes of the first pair of cutting members.

According to a second aspect of the present invention there is provided a method of cutting a pile using an apparatus in accordance with the first aspect of the invention, the method comprising:

(a) positioning the apparatus about a pile such that a portion of the pile is located between the first and second cutting edges, with the first and second cutting edges being in their respective rest positions; and (b) rotating each of the first and second cutting members about their primary pivot axes in order to move the first and second cutting edges towards their respective cutting positions.

In some embodiments, in moving the first and second cutting edges towards their cutting positions, the cutting edges are brought into contact with opposing surfaces of the pile. In such embodiments, the method may comprise continuing to move the cutting edges towards their respective cutting positions in order to apply a cutting force to the opposing surfaces of the pile in order to cut the pile.

The method may comprise using an apparatus of the invention to cut a pile which comprises a circular cross-section. Alternatively, the method may comprise cutting a pile which comprises a polygonal cross-section. For example, the method may comprise cutting a pile which comprises a triangular, square or rectangular cross-section.

In some embodiments step (b) may comprise rotating each of the first and second cutting members about their respective primary pivot axes under the operation of one or more actuators. In such embodiments, the method may comprise controlling the operation of the or each actuator to control the cutting process. The method may comprise using a first actuator to control the rotation of the first cutting member about its primary pivot axis, and a second actuator to control the rotation of the second cutting member about its primary pivot axis. In such embodiments, the first and second actuators may be controlled independently and the method may comprise rotating the first and second cutting members independently. Alternatively, the method may comprise rotating the cutting members simultaneously and preferably at the same rate to provide a uniform cutting force from both cutting edges of the apparatus.

In some embodiments the method may comprise rotating each of the first and second cutting members about separate secondary pivot axes to cause a simultaneous rotation of said cutting members about respective primary pivot axes. In such embodiments, the rotation of the first and second cutting members about their respective secondary pivot axes may be effected under the operation of one or more actuators. In some embodiments the method may comprise using one or more actuators to move the respective secondary pivot axes laterally. The lateral movement of the respective secondary pivot axes may cause the first and second cutting members to rotate about said secondary pivot axes. In such embodiments, the method may comprise rotating the first and second cutting members about their respective secondary pivot axes to effect a simultaneous rotation of the cutting members about their respective first pivot axes to move the first and second cutting edges towards their respective cutting positions.

The method may additionally comprise removing a cut portion of a pile away from the remainder of the pile after the pile is cut. In some embodiments the method may comprise physically moving the apparatus away from the uncut pile subsequent to cutting the pile. In such embodiments, the cutting edges of the first and second cutting members may be retained in their respective cutting positions whilst the apparatus is moved away from the uncut pile. In this way, the cut portion of the pile is retained within the apparatus and is moved away from the uncut pile when moving the apparatus. The method may additionally comprise moving the cutting edges from their respective cutting positions back towards respective rest positions in order to release the cut portion of the pile from the apparatus. This may be achieved through rotation of the first and second cutting members about their respective primary pivot axes, and in some embodiments about their respective secondary pivot axes, in the opposite direction.

According to a third aspect of the present invention there is provided a connection device for connecting a pile cutting apparatus to a lifting device, the connection device comprising a bolt and a locking nut; the bolt comprising a head having an opening therethrough for connection to a component of a lifting mechanism and a threaded portion; wherein the head is rotatable with respect to the threaded portion, in use.

The head of the bolt may be rotatable with respect to the threaded portion between two or more angular positions. In some embodiments the head of the bolt may be fully rotatable about 360° with respect to the threaded portion.

The connection device may be configured such that when securely connected to a pile cutting apparatus, the head of the bolt remains freely rotatable with respect to the threaded portion. In this way, the connection device provides a means to connect one or more components of a lifting mechanism to a pile cutting apparatus which ensures that the pile cutting apparatus may itself rotate with respect to the lifting mechanism. This prevents unwanted tangling or crossing of any wires or ropes which may act as an intermediary members to connect the cutting apparatus to the lifting mechanism.

The locking nut may comprise an annular ring having a threaded portion on an interior surface thereof. The threaded portion of the locking nut preferably corresponds to the threaded portion on the bolt such that the locking nut may be engage with the threaded portion of the bolt for securing the locking nut thereto.

The threaded portion of the bolt may be configured to be located within or through an aperture in a pile cutting apparatus, in use. The aperture in the pile cutting apparatus may be provided within a section or plate of the pile cutting apparatus. The connection device may be configured such that, in use, a portion of the bolt and the locking nut act on opposing surfaces of a section or plate of a connected pile cutting apparatus to provide a secure connection thereto.

In some embodiments the connection device may comprise one or more ropes which may act as an intermediary member to connect the device to a lifting mechanism. The one or more ropes may comprise a hook at an end thereof. The hook may be operable to be located within or through the opening in the head of the bolt for connecting the rope thereto. In some embodiments, the one or more ropes may comprise a second hook at an opposing end thereof. The second hook may be operable in use to connect the rope to a component of a lifting apparatus. The one or more ropes may comprise a wire rope formed from a metallic material, which may be aluminium, copper, steel or any combination thereof, for example.

According to a fourth aspect of the present invention there is provided a pile cutting apparatus comprising a connection device of the third aspect of the present invention.

The pile cutting apparatus may comprise a pile cutting apparatus in accordance with the first aspect of the present invention.

DETAILED DESCRIPTION OF THE INVENTION

In order that the invention may be more clearly understood an embodiment thereof will now be described, by way of example only, with reference to the accompanying drawings, of which:

Figure 1:
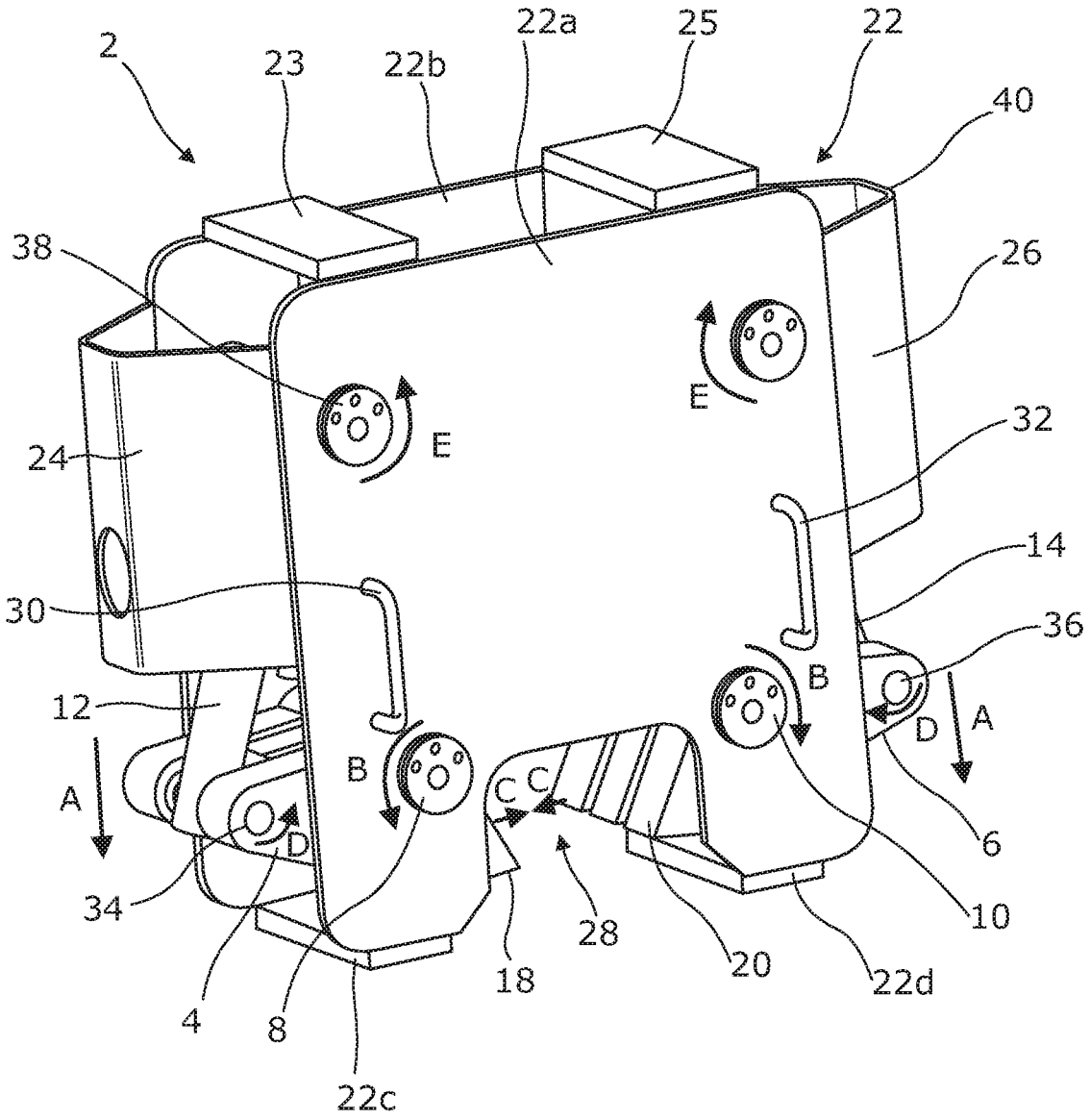
FIG. 1 is a perspective view of an embodiment of a pile cutting apparatus in accordance with the present invention.

FIG. 1 illustrates an embodiment of an apparatus 2 of the invention. The apparatus 2 comprises a first cutting member 4 and a second cutting member 6, each comprising a cutting edge 18, 20, respectively. The first and second cutting members 4, 6 are pivotally mounted at a first primary pivot axis 8 and a second primary pivot axis 10, respectively, and are rotatably moveable with respect to said axes, 8, 10. In addition, first and second cutting members 4, 6 are pivotally mounted at respective first and second secondary pivot axes 34, 36. Said primary pivot axes 8, 10 are fixedly connected to a supporting frame 22 whereas said secondary pivot axes 34, 36 are moveable with respect to said supporting frame 22.

As can be seen in FIG. 1 the primary pivot axes 8, 10 are aligned linearly with their respective secondary pivot axes 34, 36 when the cutting members 4, 6 are in the rest position. All of the primary pivot axes 8, 10 and secondary pivot axes 34, 36 are therefore aligned in the same horizontal plane and linearly, in the rest position.

The apparatus 2 additionally comprises a first actuator in the form of operating ram 12 and a second actuator in the form of operating ram 14. The operating rams 12, 14 may be hydraulic or pneumatic rams, the operation of which will be readily understood. The operating rams 12, 14 are connected at a first end to respective secondary pivot axes 34, 36 and at a second end to respective actuator pivot axes 38, 40. Actuator pivot axes 38, 40 are fixedly connected to the supporting frame 22 whereas, as discussed above, secondary pivot axes 34, 36 are moveable with respect to the supporting frame 22. The operating rams 12, 14 are rotatable about each of the pivot axes to which they are connected. First and second operating rams 12, 14 are comprised of a main body portion and an extending arm, wherein the extending arm is moveable with respect to the main body portion to protrude therefrom at various distances. It is the protrusion of the extending arm from the main body portion, along with the rotation of the operating rams 12, 14 about their respective actuator pivot axes 38, 40 which effects movement of the respective cutting members 4, 6 as will be described in detail, below.

The supporting frame 22 is comprised of a front plate 22*a*, a rear plate 22*b*, first and second base plates 22*c*, 22*d*, first and second actuator plates 23, 25, and first and second actuator covers 24, 26. Primarily, the supporting frame 22 is provided to form an enclosed area which partially contains each of the moveable components of the apparatus 2. The supporting frame 22 also defines an opening 28 therein disposed between the base plates 22*c*, 22*d* allowing the apparatus to be positioned about a pile, the pile being located within the opening 28 between the cutting edges 18, 20 of the cutting members 4, 6.

In addition, there is provided first and second handles 30, 32 on the exterior of the front plate 22*a* to aid in manual movement of the apparatus 2, in use. There may also be provided corresponding handles on the rear plate 22*b*, however, this is not shown in FIG. 1. Although not shown in the illustrated embodiment, the apparatus 2 may additionally comprise one or more connection points for connecting a lifting mechanism thereto to aid in the movement of the apparatus 2, in use. In some embodiments the one or more connection points may be provided on the supporting frame 22.

The operational use of the apparatus 2 will now be described with reference to FIG. 1.

The apparatus 2 may initially be provided in a rest configuration. In this configuration, the operating rams 12, 14 may be in an unactuated position whereby their extending arm is fully, or almost fully contained within the main body portion of the ram 12, 14. In this position, the secondary pivot axes 34, 36 are located at their highest point (in the orientation shown in the Figure) with respect to the corresponding primary pivot axes 8, 10 and the angular position of the cutting members 4, 6 with respect to the primary pivot axes 8, 10 is such that the respective cutting edges 18, 20 of the cutting members 4, 6 are separated by a first distance. It is necessary for the first distance to be large enough to allow a pile to be placed between said cutting edges 18, 20 when in this configuration. The apparatus 2 may then be placed about a pile (not shown) by positioning the pile within the opening 28 between the respective cutting edges 18, 20 of the cutting members 4, 6.

In order to cut a pile located between the cutting edges 18, 20 the operating rams 12, 14 are used to force the secondary pivot axes 34, 36 in a downwards direction (in the orientation shown in the Figure) in the direction of arrow A. This is achieved through the projection of the extending arms from the main body portions of the operating rams 12, 14 under hydraulic or pneumatic pressure as will be readily understood.

The movement of the secondary pivot axes 34, 36 in this way causes the first and second cutting members to rotate about said secondary pivot axes 34, 36 in the direction of arrow D. This lateral movement of the secondary axes 34, 36, along with the rotational movement of the first and second cutting members 4, 6 about said the secondary pivot axes 34, 36 effects a simultaneous rotation of the cutting members 4, 6 about respective primary pivot axes 8, 10 in the direction of arrow B. In doing so, the cutting edges 18, 20 are brought towards each other and towards a cutting position in the direction of arrow C.

With a pile located therebetween, cutting edges 18, 20 are brought into contact with opposing surfaces of the pile and apply a force thereto in order to cut the pile. This force is applied through the action of the operating rams 12, 14 and various pivot axes 8, 10, 34, 36 as described above, with the cutting force being directly proportional to the hydraulic or pneumatic force provided by the operating rams 12, 14 in projecting the extending arm therefrom.

In addition, the operating rams 12, 14 may be additionally rotatable about respective actuator pivot axes 38, 40. For example, upon actuation of the operating rams 12, 14, i.e. upon projection of the extending arm, the operating rams 12, 14 may rotate about respective actuator pivot axes 38, 40 in the direction of arrow E. This rotation of the operating rams 12, 14 may aid in the movement of the cutting edges 18, 20 of respective first and second cutting members 4, 6 towards their respective cutting positions.

Subsequent to cutting a pile, the apparatus 2 may be reset by moving the cutting edges 18, 20 of the first and second cutting members 4, 6 back to their respective rest positions. This may be effected by withdrawing the extending arms of the operating rams 12, 14 back from their extended positions to a position wherein each of the extending arms of the operating rams 12, 14 are substantially contained within the respective main body portions. In doing so, the secondary pivot axes 34, 36 are pulled upwards (in the opposite direction to arrow A), the first and second cutting members 4, 6 are rotated about the secondary pivot axes (in the opposite direction to arrow D), and are rotated about the primary pivot axes 8, 10 (in the opposite direction to arrow B. In doing so, cutting edges 18, 20 are moved away from each other.

Figure 2:
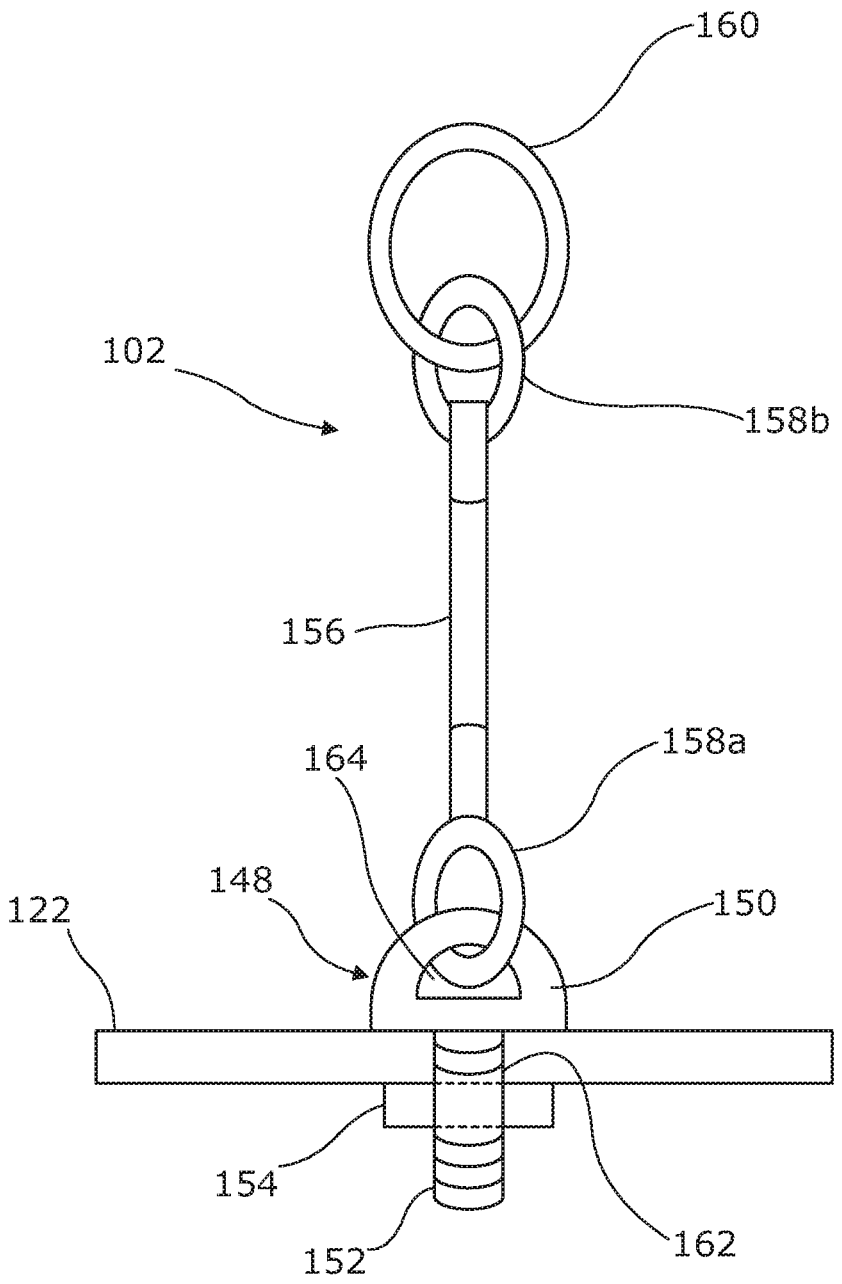
FIG. 2 is a side cross sectional view of an embodiment of a connection device in accordance with the present invention.

FIG. 2 illustrates a connection device 102 in accordance with the invention. The connection device 102 comprises a bolt 148 which includes a head 150 and a threaded portion 152, along with a locking nut 154 shown securely connected to the threaded portion 152 of the bolt 148. In addition, the illustrated connection device 102 comprises a rope 156 having hooks 158*a*, 158*b* at opposing ends thereof. A first hook 158*s* is shown connected through an opening 164 in the head 150 of the bolt 148, with the second hook 158*b* shown connected through supporting ring 160. The supporting ring 160 may be operable to be connected to one or more further ropes which may themselves be connected to a separate portion of a pile cutting apparatus to connection device 102.

The connection device 102 is shown in FIG. 2 connected to a portion of a pile cutting apparatus. In the illustrated embodiment, the portion of the pile cutting apparatus comprises a plate 122 which may comprise part of a supporting frame, for example. In order to connect the connection device 102 to the plate 122, the threaded portion 152 of the bolt 148 is inserted through an aperture 162 in the plate 122 until a lower surface of the bolt 148 comes into contact with an upper surface of the plate 122. The bolt 148 is then secured in position by screwing locking nut 154 into the position shown in FIG. 2 where it abuts a lower surface of the plate 122.

The head 150 of the bolt 148 is rotatable with respect to the threaded portion 152 even where the bolt is securely fastened to the plate 122 of a pile cutting apparatus. In this way, the apparatus itself may be rotatable with respect to the rotatable head 150 and hence the rope 156 and supporting ring 160 of the connection device 102. By allowing the apparatus to be rotatable in this way, this prevents unwanted twisting of the rope 156 or indeed tangling or crossing of the rope 156 with one or more further ropes which may be connected at other points of the cutting apparatus.

Figure 3:
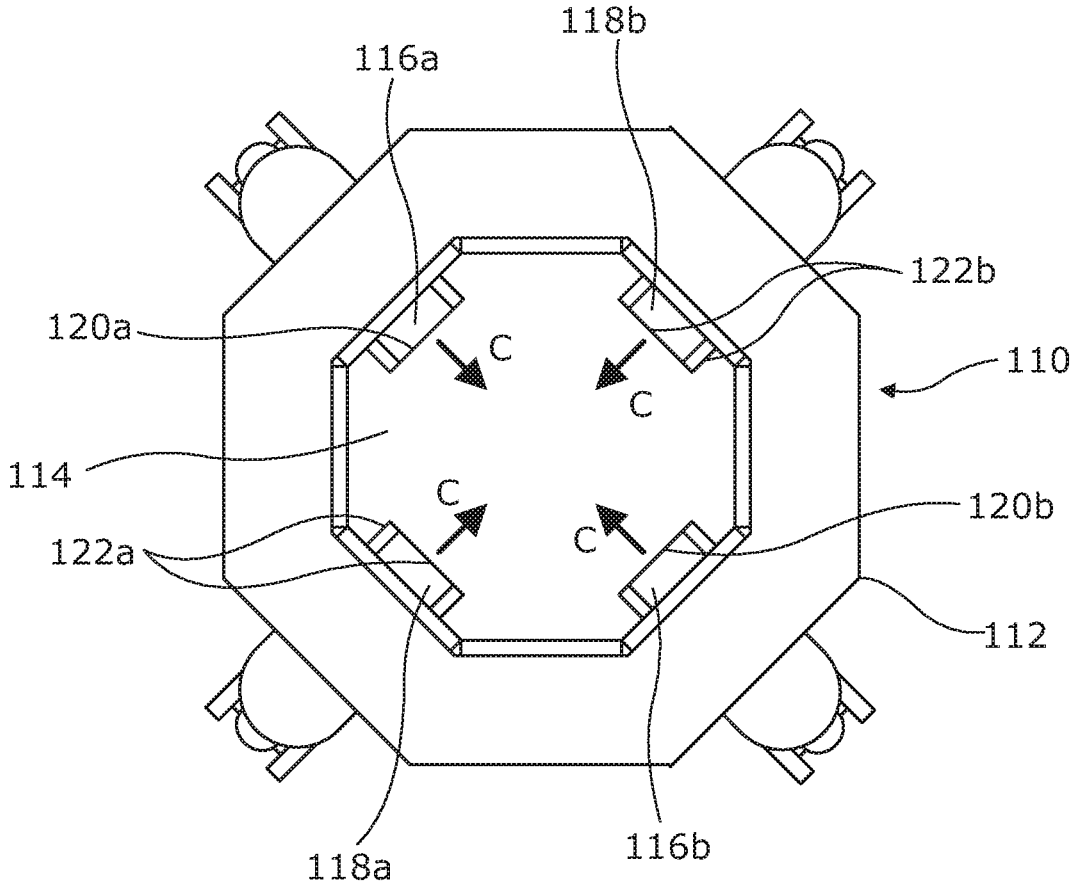
FIG. 3 is a plan view of a second embodiment of a pile cutting apparatus of the invention.

A second embodiment of a pile cutting apparatus 110 of the present invention is illustrated in FIG. 3. The apparatus 110 includes a supporting frame 112 having a bore 114 therethrough. The illustrated supporting frame 112 comprises an octagonal cross-section. Mounted to the supporting frame 112 are a first pair of cutting members 116*a*, 116*b*, each having respective cutting edges 120*a*, 120*b*, which are mounted onto opposing outer surfaces of the octagonal supporting frame 112. Similarly, mounted onto further opposing outer surfaces of the supporting frame 112 are a second pair of cutting members 118*a*, 118*b* each comprising respective cutting edges 122*a*, 122*b*. In this way, the cutting members 116*a*, 116*b*, 118*a*, 118*b* are mounted onto alternating outer surfaces of the supporting frame 112.

The octagonal bore 114 defines a volume into which a portion of a pile may be located, in use. By providing a bore 114 having an octagonal cross-section, the apparatus 110 of the invention may be used to cut either circular and square piles, or piles having a pentagonal, hexagonal, heptagonal or octagonal cross-section, for example.

In the embodiment shown in FIG. 3 the first pair of cutting members 116*a*, 116*b* are mounted on primary and secondary pivot axes which are aligned linearly in the same horizontal plane, while the primary and secondary pivot axes of the second pair of cutting members 118*a*, 118*b* are aligned linearly in the same plane, in the rest position. The primary and secondary pivot axes of the first pair of cutting members 116*a*, 116*b* and second pair of cutting members 118*a*, 118*b* are also aligned in the same horizontal plane. The first and second pair of cutting members are aligned orthogonally to each other, such that each cutting member 116*a*, 116*b*, 118*a*, 118*b* extend 90° radially from adjacent cutting members.

The above embodiment is described by way of example only. Many variations are possible without departing from the scope of the invention as defined in the appended claims.

The invention claimed is:

1. An apparatus for cutting a pile comprising a pair of cutting members comprising a first cutting member having a first cutting edge and a second cutting member having a second cutting edge; wherein the first and second cutting members are pivotally mounted at separate primary pivot axes and are moveable about said primary pivot axes in order to move the first and second cutting edges with respect to each other between rest and cutting positions; and wherein the first and second cutting edges are parallel with respect to each other when in their respective cutting positions, wherein the first and second cutting members are additionally mounted at respective secondary pivot axes and the primary pivot axes and secondary pivot axes are all aligned in the same plane in the rest position, further comprising a supporting frame to which one or more components of the apparatus are mounted, wherein the apparatus comprises one or more actuators and the cutting members are moveable about their respective primary pivot axes under the operation of said one or more actuators, and wherein the one or more actuators comprise a moveable portion which is operable in use to move the secondary pivot axes of the cutting members in order to effect movement of the cutting members about the primary pivot axes.

2. The apparatus as claimed in claim 1 wherein the primary pivot axes and secondary pivot axes are aligned linearly in the rest position.

3. The apparatus as claimed in claim 1 wherein the cutting edges are positioned parallel to one another in both their rest position and their cutting positions and remain parallel when moving between these positions, in use.

4. The apparatus as claimed in claim 1 wherein the first and second cutting edges are in their respective rest positions when they are separated by a given distance and are moveable to their respective cutting positions by moving the cutting edges closer together.

5. The apparatus as claimed in claim 1 wherein the support frame comprises a bore therethrough, and wherein the bore is octagonal in cross-section.

6. The apparatus as claimed in claim 1 comprising two actuators.

7. The apparatus as claimed in claim 6 wherein the cutting members are moveable about their respective primary pivot axes under the operation of respective actuators, the respective actuators comprising a first actuator operable to control the movement of the first cutting member and a second actuator operable to control the movement of the second cutting member.

8. The apparatus as claimed in claim 1 wherein the or each actuator comprises a moveable portion operable in use to act directly on one or both of the cutting members, or a surface thereof, in order to effect movement of the cutting members about their respective primary pivot axes.

9. The apparatus as claimed in claim 1 wherein the moveable portion of the or each actuator is operable to cause the secondary pivot axes of the cutting members to move laterally or rotationally.

10. The apparatus as claimed in claim 1 wherein the moveable portion or each actuator comprises an operating ram.

11. The apparatus of claim 10 wherein the or each operating ram comprises a hydraulic or pneumatic operating ram.

12. The apparatus as claimed in claim 1 wherein the cutting members are operable in use to retain a cut section of a pile within the apparatus when the corresponding cutting edges are in their respective cutting positions.

13. A method of cutting a pile using an apparatus of claim 1, the method comprising the steps of:

(a) positioning the apparatus about a pile such that a portion of the pile is located between the first and second cutting edges, with the first and second cutting edges being in their respective rest positions; and (b) rotating each of the first and second cutting members about their primary pivot axes in order to move the first and second cutting edges towards their respective cutting positions, wherein step (b) comprises rotating each of the first and second cutting members about their respective primary pivot axes under the operation of one or more actuators.

14. The method as claimed in claim 13 wherein in moving the cutting edges towards their cutting positions, the first and second cutting edges are brought into contact with opposing surfaces of the pile.

15. The method as claimed in claim 14 comprising continuing to move the cutting edges towards their respective cutting positions after coming into contact with the opposing surface of the pile in order to apply a cutting force to the opposing surfaces of the pile in order to cut the pile.

16. The method as claimed in claim 14 comprising using a first actuator to control the rotation of the first cutting member about its primary pivot axis and a second actuator to control the rotation of the second cutting member about its primary pivot axis.

17. The method as claimed in claim 16 wherein the first and second actuators are controlled independently and the method comprises rotating the first and second cutting members independently.

18. The method as claimed in claim 17 comprising rotating the cutting members simultaneously and at the same rate to provide a uniform cutting force from both cutting edges of the apparatus.

* * * * *